US005791780A

United States Patent [19]

Bakker

[11] Patent Number: 5,791,780

[45] Date of Patent: Aug. 11, 1998

[54] IMPELLER ASSEMBLY WITH ASYMMETRIC CONCAVE BLADES

[75] Inventor: Andries Bakker, Dayton, Ohio

[73] Assignee: Chemineer, Inc., Dayton, Ohio

[21] Appl. No.: 846,334

[22] Filed: Apr. 30, 1997

[51] Int. Cl.[6] ..... B01F 7/16

[52] U.S. Cl. ..... 366/317; 366/102; 366/330.3; 261/86; 261/93

[58] Field of Search ..... 366/101, 102, 366/106, 279, 317, 325.1, 325.92, 330.1, 330.2, 330.3, 330.7; 416/197 R, 243; 261/86, 87, 93

[56] References Cited

U.S. PATENT DOCUMENTS

| | | | |
|---|---|---|---|
| 4,193 | 9/1845 | Phleger | 416/204 R |
| 636,400 | 11/1899 | Friedman | 416/211 |
| 1,372,834 | 3/1921 | Schmelzer | 416/197 R |
| 2,350,939 | 6/1944 | Sprouse | 416/197 R |
| 3,879,949 | 4/1975 | Hays et al. | 416/197 |
| 4,305,673 | 12/1981 | Herbst | 366/343 |
| 4,519,715 | 5/1985 | Golobic et al. | 366/343 |
| 4,779,990 | 10/1988 | Hjort et al. | 366/102 |
| 5,198,156 | 3/1993 | Middleton et al. | 261/87 |
| 5,246,289 | 9/1993 | Middleton et al. | 366/330.1 |
| 5,246,342 | 9/1993 | Bergstein | 416/197 R |
| 5,316,443 | 5/1994 | Smith | 416/197 R |

FOREIGN PATENT DOCUMENTS

| | | |
|---|---|---|
| 451893 | 12/1948 | Canada . |
| 123731 | 7/1931 | Germany . |
| 2207144 | 8/1973 | Germany . |
| 16592 | 8/1908 | United Kingdom . |

*Primary Examiner*—Tony G. Soohoo
*Attorney, Agent, or Firm*—Thompson Hine & Flory LLP

[57] ABSTRACT

An impeller assembly for agitating a fluid contained in a vessel and dispersing a gas introduced therein. The impeller assembly includes an impeller having a plurality of generally radially extending blades. Each of the blades includes diverging upper and lower sheet-like portions having generally radially extending leading edges. The upper and lower portions are joined to form a generally V-shaped cross-section with a trailing vertex. The width of the upper portion of each blade is greater than the width of the lower portion of the blade such that the upper portion leading edge extends forwardly of the lower portion leading edge, thus producing an upper portion overhang to capture and disperse rising gas bubbles. The impeller assembly further comprises a drive assembly for rotating the impeller assembly.

83 Claims, 3 Drawing Sheets

IMPELLER ASSEMBLY WITH ASYMMETRIC CONCAVE BLADES

BACKGROUND

The present invention relates to devices and methods for dispersing gases in fluids and, more particularly, to impeller assemblies for use in vessels to mix gases with fluids.

It is often desired to mix a gas in a fluid to effect dispersement of the gas throughout the fluid. Gas-fluid mixing operations are often utilized in a variety of oxygenation and hydrogenation processes, as well as fermentation operations. One conventional method of dispersing a gas into a fluid in a vessel utilizes an impeller immersed in the fluid for dispersing the gas, and a gas sparger for introducing gas bubbles into the fluid. Typically, the impeller includes a plurality of blades mounted on a horizontally-oriented disk-shaped rotor member which, in turn, is mounted on a shaft. A variety of blade shapes may be used in conjunction with such an impeller, including flat plates, solid wedge-shaped elements, or hollow concave blades.

In operation, the impeller is rotated in a horizontal plane while a sparger releases gas bubbles into the fluid below the impeller. The rotating impeller blades act upon the surrounding fluid and the rising gas bubbles contained therein, redirecting the fluid and bubbles in a radial direction, thereby effecting mixing and dispersement of the gas in the fluid.

The use of flat plates as impeller blades in the aforementioned apparatus results in gas filled cavities forming adjacent to the trailing face of the blades during operation. This phenomenon causes the power draw of the impeller to drop, which indicates that the pumping rate or capacity of the impeller has decreased. As a result, the gas is not completely dispersed throughout the fluid, but instead simply rises to the fluid surface. This situation is termed "flooded," and is detrimental to mass transfer between the fluid and gas. Every impeller, rotating at a given speed, has a flooding point at which the amount of gas introduced into the liquid is so great that the impeller cannot disperse the gas in the fluid satisfactorily.

Concave blades (oriented such that the concavity faces forward) are used to counter this effect, since they reduce the size of the cavities formed behind the blades, and thereby increase the power draw. The effect of the gas-filled cavities is also reduced by further increasing the curvature of the blades to produce a "deeper" blade profile. Such a blade contour also increases power draw when gas is present.

However, there is a need to maximize the effectiveness of such an impeller in dispersing gas in a fluid to break up the rising gas bubbles. Accordingly, there exists a need for an impeller assembly for dispersing a gas in a fluid with a high gassed power draw, a minimal effect of gas-filled cavities, while yielding high mixing efficiencies without the impeller being flooded.

SUMMARY OF THE INVENTION

The present invention is an impeller assembly for dispersing gas introduced into a fluid-filled vessel, which has a high gassed power draw, causes minimal cavitation behind the blades, and provides effective, thorough dispersement of the gas throughout the fluid. In addition, the impeller assembly has a much higher flooding point than prior art impellers of comparable size and speed.

In particular, the impeller assembly of the present invention utilizes concave impeller blades which are asymmetric in that they include an upper portion overhang to capture and disperse rising gas bubbles in a fluid. Since the flow of rising gas bubbles in a fluid is perpendicular to the plane of impeller rotation, the present invention accounts for such asymmetries in the gas flow by providing an overhang to capture and disperse gas bubbles that would rise undispersed through a conventional concave impeller.

As a result, the impeller assembly of the present invention provides high mixing efficiencies. In addition, the overhang shape enables the impeller assembly of the present invention to accommodate greater amounts of gas without flooding.

In a preferred embodiment of the impeller assembly of the present invention, an impeller having a disk member includes a plurality of generally radially extending blades mounted on and spaced evenly about the circumference of the disk member. Each of the blades includes diverging upper and lower sheet-like portions having generally radially extending leading edges. The upper and lower portions are joined to form a generally V-shaped cross-section with a trailing vertex. The width of the upper portion of each blade is greater than the width of the lower portion of the blade such that the upper portion leading edge extends forwardly of the lower portion leading edge, thus producing the upper portion overhang.

The impeller assembly further preferably comprises a drive assembly for rotating the impeller such that the upper portion segment catches and disperses the rising gas bubbles. Also in the preferred embodiment, the upper and lower portions extend from the vertex such that a distance from a point on the upper portion to a plane of the disk member is substantially equal to a distance to the disk member plane of a corresponding point on the lower portion such that the upper and lower portions diverge uniformly relative to the plane.

Accordingly, it is an object of the present invention to provide an impeller assembly for dispersing a gas introduced into a fluid-filled vessel which produces a high ratio of gassed to ungassed power draw and relatively small gas-filled cavities; an impeller assembly which is relatively robust; an impeller assembly which is relatively easy to maintain; and an impeller assembly which provides effective, efficient, and complete dispersement of a gas sparged into a liquid.

These and other objects and advantages of the present invention will be more fully understood and appreciated by reference to the following description, the accompanying drawings and the appended claims.

DETAILED DESCRIPTION

Figure 1:
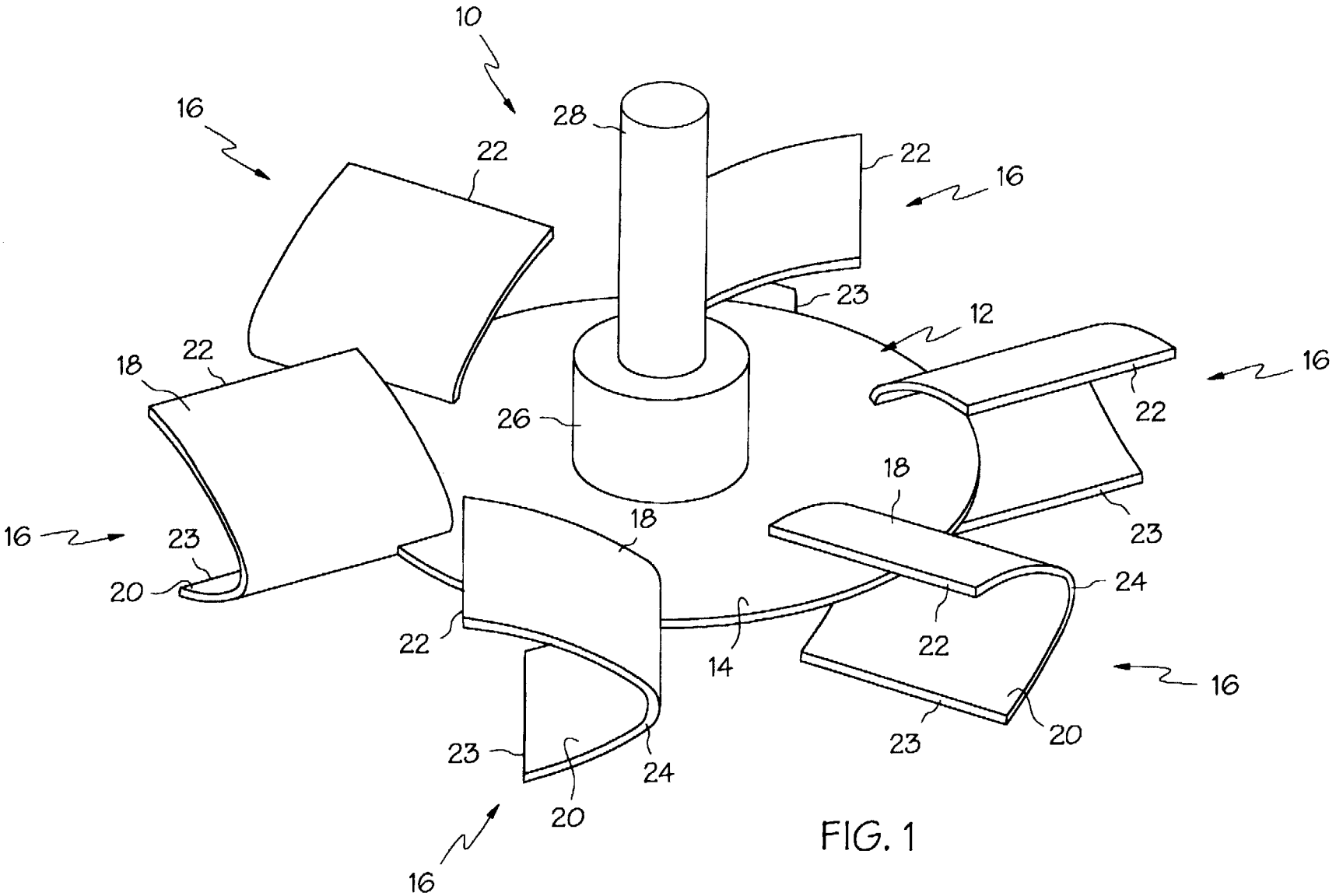
FIG. 1 is a perspective view of a preferred embodiment of the impeller assembly of the present invention.
Figure 2:
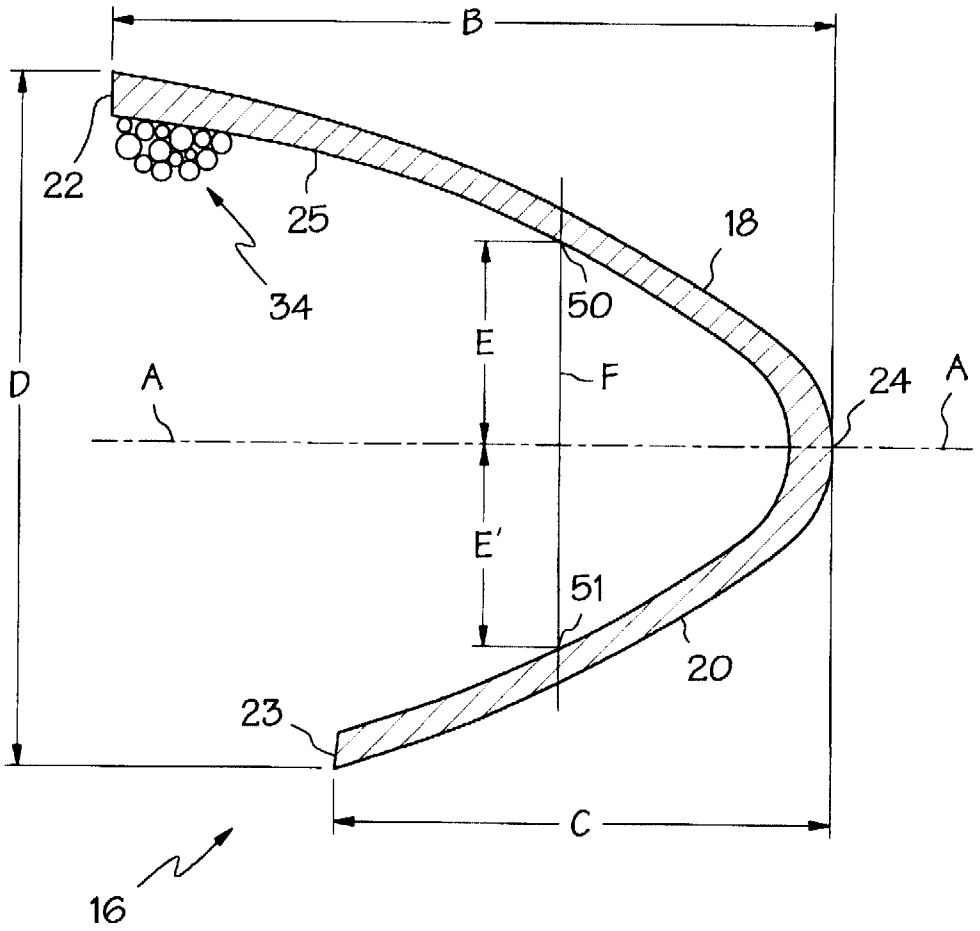
FIG. 2 is a detail side elevation in section of an impeller blade of the assembly of FIG. 1.
Figure 3:
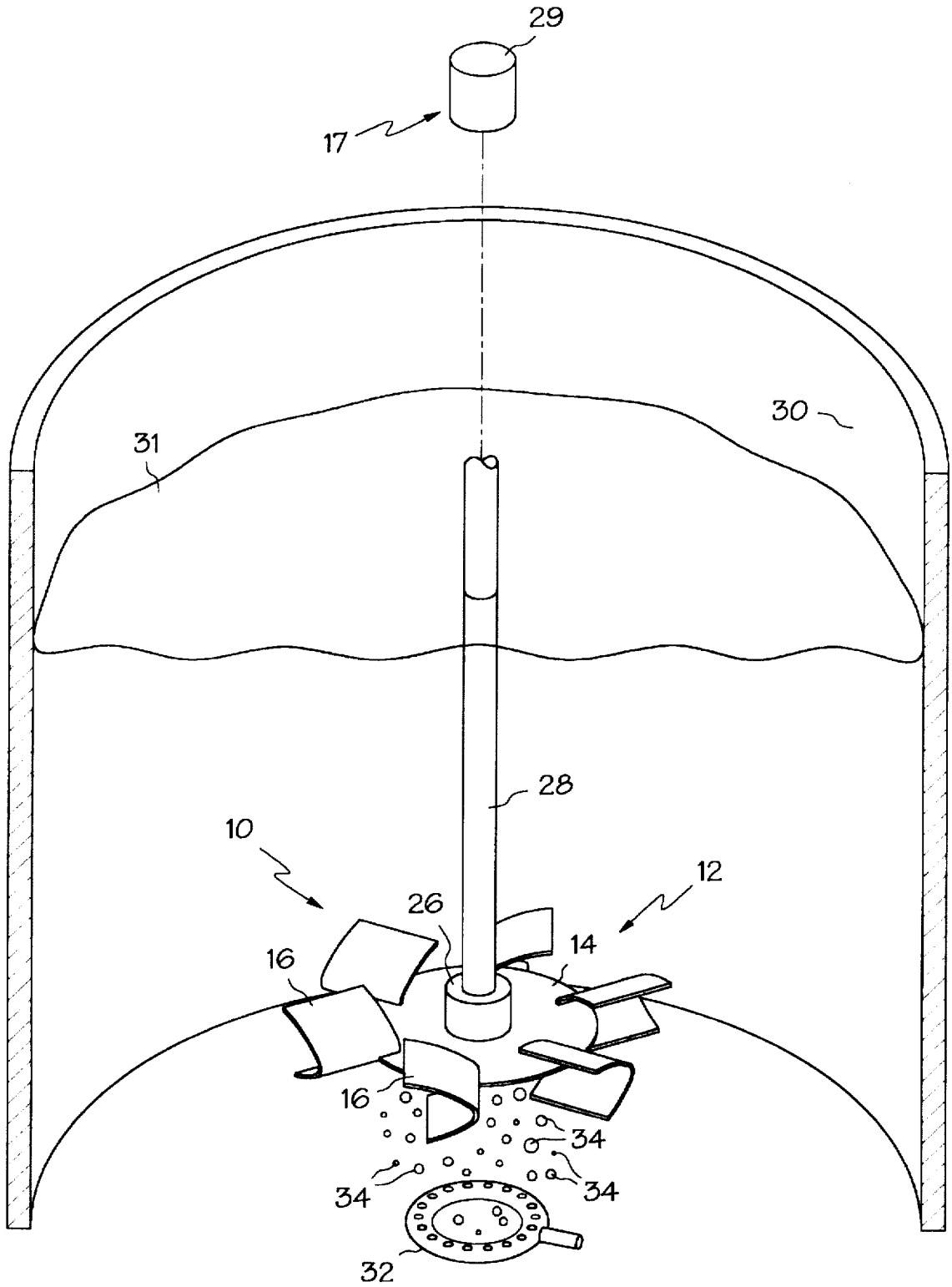
FIG. 3 is a perspective view of the impeller assembly of FIG. 1 shown in a cylindrical vessel, the vessel shown in section.

As shown in FIGS. 1 and 3, a preferred embodiment of the impeller assembly of the present invention, generally designated 10, includes an impeller 12, comprised of a disk member 14 and a plurality of generally radially extending blades 16, and a drive member 17 (see FIG. 3). With reference to FIGS. 1 and 2, the blades 16 include diverging upper and lower sheet-like portions 18, 20. Each of the portions 18, 20 has a generally radially extending leading edge 22, 23. The upper and lower portions 18, 20 are joined to form a generally V-shaped cross section with a trailing vertex 24. The blades 16 are preferably generally parabolic in cross section (see FIG. 2), and the vertex 24 is preferably curved. As shown in FIG. 2, the upper and lower portions 18, 20 are angled so that they diverge from the plane A of the disk member approximately symmetrically.

The width of the upper portion 18 of the blades 16 (represented by dimension B) is greater than the width of the lower portion 20 (represented by dimension C). Consequently, the leading edge 22 extends in front of the leading edge 23, creating an overhang 25. The overhang 25 captures rising gas bubbles 34 and thereby promotes their dispersion. The optimal blade design utilizes a configuration wherein the overhang 25 represents about 15–50% of the width B of the upper portion 18. More preferably, the overhang 25 represents about 25% of the width B. The impeller blade 16 further has a height dimension D. The height-to-width ratio (i.e. D:B) of the blades 16 of the present invention optimally is in the range of about 0.5:1 to 1.5:1, with 1:1 being preferred.

As shown in FIGS. 1 and 3, the impeller 12 preferably has six blades 16 mounted on the disk member 14. The impeller 12 may have other numbers of blades, ranging from 4 to 12 blades, without departing from the scope of the invention. The blades 16 are preferably evenly spaced circumferentially about the disk member 14, and preferably are attached to the disk member 14 at their vertices 24. Preferably, the blades 16 are notched to receive the disk member 14. The ratio of the radius of the disk member 14 to the radius of the impeller 16 optimally is in the range of about 0.5 to 0.8, with 0.65 being preferred.

The impeller assembly 10 further includes a hub 26 for mounting the assembly on a shaft 28. The shaft 28 is attached to a drive motor 29, so that the drive motor 29 and shaft 28 comprise the drive assembly 17. The impeller assembly 10 preferably is rotated in a substantially horizontal plane such that the vertex 24 trails the leading edges 22, 23 of the blades 16.

As shown in FIG. 3, the impeller assembly 10 is utilized with a vessel 30 filled with a fluid 31. The fluid 31 may be a slurry, a liquid, or a mixture of liquids. Substantially cylindrical vessels 30 are preferred, but other shapes, such as rectangular vessels or other shapes in elevation, may be used in accordance with the present invention. The impeller assembly and vessel are selected such that the ratio of impeller diameter to the vessel diameter is optimally in the range of about 0.2 to 0.6, with 0.4 being preferred. The impeller assembly 10 is submersed in the fluid 31, and is preferably located near the bottom of the vessel 30. The impeller assembly 10 is located such that the shaft 28 is generally vertically oriented and centered in the vessel 30. The assembly 10 is suspended above a gas sparger 32, which is connected to a source of gas under pressure (not shown) and releases the gas to be mixed into the fluid as gas bubbles 34.

The disk member 14 may be of various geometric configurations, can be of other shapes in elevation, or may include cut-outs or spokes of various shapes without departing from the scope of the invention. The disk member 14 preferably has a thickness less than its radius. The impeller assembly 16 is preferably constructed of stainless steel or other non-corrosive materials, such as titanium, but may be constructed of less durable materials, such as carbon steel.

The present invention further provides for an impeller as described above wherein the upper portion 18 and lower portion 20 uniformly diverge from the vertex 24 with respect to the disk member plane A. The distance from each point on the upper portion 18 to the disk member plane A is substantially equal to the distance from a corresponding point on the lower portion 20 to the disk member plane A. For illustrative purposes, upper point 50 on upper portion 18, and its corresponding point, lower point 51, are shown in FIG. 2. Line F is a line perpendicular to the disk plane A and passing through upper point 50. Lower point 51 is located at the point where line F intersects the lower portion 20. The distance from the plane of the disk member A to upper point 50 is shown as distance E. The distance from lower point 51 to the disk member plane A is shown as distance E'. In accordance with the present invention, the distance E is substantially equal to the distance E'. This relation holds true for all points on the upper portion 18 and their corresponding points on the lower portion 20.

The operation of the impeller assembly 10 is as follows. In order to effect mixing of gas 34 with the liquid 31, the impeller assembly 10 is rotated in a horizontal plane while the sparger 32 releases gas into the fluid below the impeller. The drive member 17 rotates the impeller 10 such that blades 16 act upon the surrounding fluid 31 and the rising gas bubbles 34 contained therein, redirecting the fluid and bubbles in a radial direction. This action further breaks up the bubbles 34 in the fluid 31. When the impeller assembly 10 has sufficient rotational speed, the gas bubbles may recirculate below the impeller assembly 10. Release of the gas bubbles 34 by the sparger 32 and rotation of the assembly 10 may continue for as long as mixing is desired.

While the forms of apparatus herein described constitute a preferred embodiment of the invention, it is to be understood that the present invention is not limited to these precise forms and that changes may be made therein without departing from the scope of the invention.

What is claimed is:

1. An impeller assembly for agitating a fluid contained in a vessel and dispersing a gas introduced therein, the impeller assembly comprising:

an impeller including a plurality of generally radially extending blades, each of said blades including diverging upper and lower sheet-like portions having generally radially extending leading edges, said upper and lower portions being joined to form a generally V-shaped cross-section with a trailing vertex, and wherein a width of said upper portion is greater than a width of said lower portion such that said upper portion leading edge extends forwardly of said lower portion leading edge, whereby a segment of said upper portion overhangs said lower portion; and a drive assembly for rotating said impeller such that said upper portion segment catches rising gas bubbles so that said impeller disperses said gas bubbles in a generally radial direction.

2. The impeller assembly of claim 1 further comprising a disk member having a thickness less than a radius thereof, said radially extending blades being mounted on and circumferentially arranged about said disk member.

3. The impeller assembly of claim 2 wherein said vertex is rounded in cross section.

4. The impeller assembly of claim 3 wherein said upper and lower portions of each said blade are arranged such that a percentage of said width of said upper portion extends forwardly of said lower portion leading edge, said percentage being in the range of about 15% to 50%.

5. The impeller assembly of claim 4 wherein each of said blades is attached to said disk member at said vertex.

6. The impeller assembly of claim 5 further comprising a hub for mounting said impeller assembly to a shaft.

7. The impeller assembly of claim 6 wherein said blades are evenly spaced circumferentially on said disk member.

8. A mixing system for agitating a fluid and dispersing a gas introduced therein comprising:

an impeller including a plurality of generally radially extending blades, each of said blades including diverging upper and lower sheet-like portions having generally radially extending leading edges, said upper and lower portions being joined to form a generally V-shaped cross-section with a trailing vertex, and wherein a width of said upper portion is greater than a width of said lower portion such that said upper portion leading edge extends forwardly of said lower portion leading edge whereby a segment of said upper portion overhangs said lower portion: and a drive assembly for rotating said impeller such that said upper portion segment catches rising gas bubbles so that said impeller disperses said gas bubbles in a generally radial direction: and a generally cylindrical vessel, said impeller being centrally radially arranged in said vessel.

9. The impeller assembly of claim 2 wherein the ratio of said disk member radius to said impeller radius is in the range of about 0.5 to 0.8.

10. The impeller assembly of claim 9 wherein each of said blades has a height-to-width ratio of between 0.5:1 and 1.5:1.

11. The impeller assembly of claim 10 wherein each of said blades has a height-to-width ratio of about 1:1.

12. The impeller assembly of claim 1 wherein said impeller has between 4 and 12 generally radially extending blades.

13. The impeller assembly of claim 12 wherein said impeller assembly has 6 generally radially extending blades.

14. The impeller assembly of claim 1 wherein each of said blades has a generally concave shape in cross section.

15. The impeller assembly of claim 1 wherein said upper and lower portions are angled to diverge from a plane of said disk member symmetrically.

16. The impeller assembly of claim 14 wherein said generally concave shape is generally parabolic.

17. The impeller assembly of claim 1 wherein said impeller assembly is fabricated from stainless steel.

18. An impeller for agitating a fluid contained in a vessel and dispersing a gas introduced therein, the impeller comprising a plurality of generally radially extending blades, each of said blades including upper and lower sheet-like portions having generally radially extending leading edges and joined to form a generally V-shaped cross-section with a trailing vertex, said upper and lower portions extending from said vertex such that a distance from a point on said upper portion to a plane of said disk member is substantially equal to a distance to said plane of a corresponding point on said lower portion such that said upper and lower portions diverge uniformly relative to said plane, and wherein a width of said upper portion is greater than a width of said lower portion such that said upper portion leading edge extends forwardly of said lower portion leading edge, whereby a segment of said upper portion overhangs said lower portion such that rotation of said impeller causes said upper portion segment to catch rising gas bubbles so that said impeller disperses said gas bubbles in a generally radial direction.

19. The impeller of claim 18 further comprising a disk member having a thickness less than a radius thereof, said generally radially extending blades being mounted on and circumferentially spaced about said disk member.

20. The impeller of claim 19 wherein said vertex is rounded in cross section.

21. The impeller of claim 20 wherein said upper and lower portions are angled to diverge from a plane of said disk member symmetrically.

22. The impeller of claim 21 wherein said upper and lower portions of each said blade are arranged such that a percentage of said width of said upper portion extends forwardly of said lower portion leading edge, said percentage being in the range of about 15% to 50%.

23. The impeller of claim 22 wherein each of said blades is attached to said disk member at said vertex.

24. The impeller of claim 23 further comprising a hub for mounting said impeller to a shaft.

25. The impeller of claim 24 wherein said blades are evenly spaced circumferentially on said disk member.

26. The impeller of claim 25 wherein the ratio of said disk member radius to said impeller radius is in the range of about 0.5 to 0.8.

27. The impeller of claim 26 wherein each of said blades has a height-to-width ratio of between 0.5:1 and 1.5:1.

28. The impeller of claim 27 wherein each of said blades has a height-to-width ratio of about 1:1.

29. The impeller of claim 28 wherein said impeller has between 4 and 12 generally radially extending blades.

30. The impeller of claim 29 wherein said impeller has 6 generally radially extending blades.

31. The impeller of claim 30 wherein each of said blades has a generally concave shape in cross section.

32. The impeller of claim 31 wherein said upper and lower portions are angled to diverge from a plane of said disk member symmetrically.

33. The impeller of claim 32 wherein said generally concave shape is generally parabolic.

34. The impeller of claim 33 wherein said impeller is fabricated from stainless steel.

35. A method for agitating a fluid contained in a vessel and dispersing a gas introduced therein, the method comprising the steps of:

selecting an impeller assembly including an impeller having a plurality of generally radially extending blades, each of said blades including diverging upper and lower sheet-like portions having generally radially extending leading edges and joined to form a generally V-shaped cross-section with a trailing vertex, and wherein a width of said upper portion is greater than a width of said lower portion such that said upper portion leading edge extends forwardly of said lower portion leading edge, whereby a segment of said upper portion overhangs said lower portion, and a drive assembly for rotating said impeller such that said upper portion segment catches rising gas bubbles so that said impeller disperses said gas bubbles in a generally radial direction;

placing said impeller assembly in a vessel;

filling said vessel with a fluid to be agitated;

rotating said impeller assembly in said fluid; and introducing a gas to be dispersed into said vessel.

36. The method of claim 35 wherein said impeller assembly rotating step includes the steps of:

initially mounting a shaft on said impeller assembly; and subsequently rotating said shaft, thereby causing said impeller assembly to be rotated.

37. The method of claim 36 wherein said shaft mounting step includes the step of orienting the shaft to be substantially vertical in said vessel such that said impeller assembly rotates in a substantially horizontal plane.

38. The method of claim 35 wherein said impeller assembly placing step includes the step of selecting a vessel which is substantially cylindrical in shape having a central axis being substantially vertically oriented.

39. The method of claim 35 wherein said impeller assembly placing step includes the step of positioning said impeller assembly near or at a bottom of said vessel.

40. The method of claim 35 wherein said gas introducing step includes the step of introducing said gas into said vessel at a location below said impeller assembly.

41. The method of claim 35 wherein said impeller assembly selecting step includes the step of selecting an impeller assembly having a disk member with a thickness less than a radius thereof, wherein said radially-extending blades are mounted on and circumferentially spaced about said disk member.

42. The method of claim 35 wherein said impeller assembly selecting step includes the step of selecting an impeller assembly wherein said vertex is rounded in cross section.

43. The method of claim 35 wherein said impeller assembly selecting step includes the step of selecting an impeller assembly wherein said upper and lower portions of each said blade are arranged such that a percentage of said width of said upper portion extends forwardly of said lower portion leading edge, said percentage being in the range of about 15% to 50%.

44. The method of claim 41 wherein said impeller assembly selecting step includes the step of selecting an impeller assembly wherein each of said blades is attached to said disk member at said vertex.

45. The method of claim 36 wherein said impeller assembly selecting step includes the step of selecting an impeller assembly wherein said impeller assembly further comprises a hub for mounting said impeller assembly to said shaft.

46. The method of claim 44 wherein said impeller assembly selecting step includes the step of selecting an impeller assembly wherein said blades are evenly spaced circumferentially on said disk member.

47. The method of claim 36 wherein said impeller assembly placing step includes the step of selecting said vessel such that the ratio of an impeller diameter to a vessel diameter is in the range of about 0.2 to 0.6.

48. The method of claim 41 wherein said impeller assembly selecting step includes the step of selecting an impeller assembly wherein the ratio of said disk member radius to said impeller radius is in the range of about 0.5 to 0.8.

49. The method of claim 35 wherein said impeller assembly selecting step includes the step of selecting an impeller assembly wherein each of said blades has a height-to-width ratio of between 0.5:1 and 1.5:1.

50. The method of claim 35 wherein said impeller assembly selecting step includes the step of selecting an impeller assembly wherein each of said blades has a height-to-width ratio of about 1:1.

51. The method of claim 35 wherein said impeller assembly selecting step includes the step of selecting an impeller assembly wherein said impeller assembly has between 4 and 12 blades.

52. The method of claim 35 wherein said impeller assembly selecting step includes the step of selecting an impeller assembly wherein said impeller assembly has 6 generally radially extending blades.

53. The method of claim 35 wherein said impeller assembly selecting step includes the step of selecting an impeller assembly wherein each of said blades has a generally concave shape in cross section.

54. The method of claim 41 wherein said impeller assembly selecting step includes the step of selecting an impeller assembly wherein said upper and lower portions are angled to diverge from a plane of said disk member symmetrically.

55. The method of claim 53 wherein said impeller assembly selecting step includes the step of selecting an impeller assembly wherein said generally concave shape is parabolic.

56. The method of claim 35 wherein said impeller assembly selecting step includes the step of selecting an impeller assembly wherein said impeller assembly is fabricated from stainless steel.

57. A method for agitating a fluid contained in a vessel and dispersing a gas introduced therein, the method comprising the steps of:

selecting an impeller including a plurality of generally radially extending blades, each of said blades including upper and lower sheet-like portions having generally radially extending leading edges and joined to form a generally V-shaped cross-section with a trailing vertex, said upper and lower portions extending from said vertex such that a distance from a point on said upper portion to a plane of said disk member is substantially equal to a distance to said plane of a corresponding point on said lower portion such that said upper and lower portions diverge uniformly relative to said plane, and wherein a width of said upper portion is greater than a width of said lower portion such that said upper portion leading edge extends forwardly of said lower portion leading edge, whereby a segment of said upper portion overhangs said lower portion such that rotation of said impeller causes said upper portion segment to catch rising gas bubbles so that said impeller disperses said gas bubbles in a generally radial direction;

placing said impeller in a vessel;

causing said vessel to be filled with a fluid to be agitated;

causing said impeller to rotate in a radial plane; and introducing a gas to be dispersed into said vessel.

58. The method of claim 57 wherein said impeller rotating step includes the steps of:

initially mounting a shaft on said impeller; and subsequently rotating said shaft, thereby causing said impeller to be rotated.

59. The method of claim 58 wherein said shaft mounting step includes the step of orienting the shaft to be substantially vertical in said vessel such that said impeller rotates in a substantially horizontal plane.

60. The method of claim 57 wherein said impeller placing step includes the step of selecting a vessel which is substantially cylindrical in shape having a central axis being substantially vertically oriented.

61. The method of claim 57 wherein said impeller placing step includes the step of positioning said impeller near or at a bottom of said vessel.

62. The method of claim 57 wherein said gas introducing step includes the step of introducing said gas into said vessel at a location below said impeller.

63. The method of claim 57 wherein said impeller selecting step includes the step of selecting an impeller having a disk member with a thickness less than a radius thereof, wherein said radially-extending blades are mounted on and circumferentially spaced about said disk member.

64. The method of claim 57 wherein said impeller selecting step includes the step of selecting an impeller wherein said vertex is rounded in cross section.

65. The method of claim 57 wherein said impeller selecting step includes the step of selecting an impeller wherein said upper and lower portions of each said blade are arranged such that a percentage of said width of said upper portion extends forwardly of said lower portion leading edge, said percentage being in the range of about 15% to 50%.

66. The method of claim 63 wherein said impeller selecting step includes the step of selecting an impeller wherein each of said blades is attached to said disk member at said vertex.

67. The method of claim 58 wherein said impeller selecting step includes the step of selecting an impeller wherein said impeller further comprises a hub for mounting said impeller to said shaft.

68. The method of claim 57 wherein said impeller selecting step includes the step of selecting an impeller wherein said impeller has between 4 and 12 blades.

69. The method of claim 57 wherein said impeller selecting step includes the step of selecting an impeller wherein said impeller has 6 generally radially extending blades.

70. The method of claim 66 wherein said impeller selecting step includes the step of selecting an impeller wherein said blades are evenly spaced circumferentially on said disk member.

71. The method of claim 58 wherein said impeller placing step includes the step of selecting said vessel such that the ratio of an impeller diameter to a vessel diameter is in the range of about 0.2 to 0.6.

72. The method of claim 63 wherein said impeller selecting step includes the step of selecting an impeller wherein the ratio of said disk member radius to said impeller radius is in the range of about 0.5 to 0.8.

73. The method of claim 57 wherein said impeller selecting step includes the step of selecting an impeller wherein each of said blades has a height-to-width ratio of between 0.5:1 and 1.5:1.

74. The method of claim 57 wherein said impeller selecting step includes the step of selecting an impeller wherein each of said blades has a height-to-width ratio of about 1:1.

75. The method of claim 57 wherein said impeller selecting step includes the step of selecting an impeller wherein each of said blades has a generally concave shape in cross section.

76. The method of claim 63 wherein said impeller selecting step includes the step of selecting an impeller wherein said upper and lower portions are angled to diverge from a plane of said disk member symmetrically.

77. The method of claim 75 wherein said impeller selecting step includes the step of selecting an impeller wherein said generally concave shape is generally parabolic.

78. The method of claim 57 wherein said impeller selecting step includes the step of selecting an impeller wherein said impeller is fabricated from stainless steel.

79. The impeller assembly of claim 8 wherein said impeller and said vessel each have a diameter and the ratio of said impeller diameter to said vessel diameter is in the range of about 0.2 to 0.6.

80. An impeller assembly for agitating a fluid contained in a vessel and dispersing a gas introduced therein, the impeller assembly comprising:

an impeller including a plurality of generally radially extending blades, each of said blades including diverging upper and lower sheet-like portions having generally radially extending leading edges, said upper and lower portions being joined to form a generally concave shaped cross-section, and wherein a width of said upper portion is greater than a width of said lower portion such that said upper portion leading edge extends forwardly of said lower portion leading edge, whereby a segment of said upper portion overhangs said lower portion; and a drive assembly for rotating said impeller such that said upper portion segment catches rising gas bubbles so that said impeller disperses said gas bubbles in a generally radial direction.

81. An impeller for agitating a fluid contained in a vessel and dispersing a gas introduced therein, the impeller comprising a plurality of generally radially extending blades, each of said blades including diverging upper and lower sheet-like portions having generally radially extending leading edges, said upper and lower portions being joined to form a generally concave shaped cross-section, and wherein a width of said upper portion is greater than a width of said lower portion such that said upper portion leading edge extends forwardly of said lower portion leading edge, whereby a segment of said upper portion overhangs said lower portion.

82. An impeller for agitating a fluid contained in a vessel and dispersing a gas introduced therein, the impeller comprising a plurality of generally radially extending blades, each of said blades including diverging upper and lower sheet-like portions having generally radially extending leading edges, said upper and lower portions being joined to form a generally concave cross-section, said upper and lower portions being shaped such that a distance from a point on said upper portion to a plane of said disk member is substantially equal to a distance to said plane of a corresponding point on said lower portion such that said upper and lower portions diverge uniformly relative to said plane, and wherein a width of said upper portion is greater than a width of said lower portion such that said upper portion leading edge extends forwardly of said lower portion leading edge, whereby a segment of said upper portion overhangs said lower portion such that rotation of said impeller causes said upper portion segment to catch rising gas bubbles so that said impeller disperses said gas bubbles in a generally radial direction.

83. A method for agitating a fluid contained in a vessel and dispersing a gas introduced therein, the method comprising the steps of:

selecting an impeller assembly including an impeller having a plurality of generally radially extending blades, each of said blades including diverging upper and lower sheet-like portions having generally radially extending leading edges, said upper and lower portions being joined to form a generally concave shaped cross-section, and wherein a width of said upper portion is greater than a width of said lower portion such that said upper portion leading edge extends forwardly of said lower portion leading edge, whereby a segment of said upper portion overhangs said lower portion; and a drive assembly for rotating said impeller such that said upper portion segment catches rising gas bubbles so that said impeller disperses said gas bubbles in a generally radial direction;

placing said impeller in a vessel;

filling said vessel with a fluid to be agitated;

rotating said impeller assembly in said fluid;

introducing a gas to be dispersed into said vessel whereby said gas rises in said fluid and is contacted by said rotating impeller and is further broken up in said fluid.

* * * * *